US005663541A

United States Patent [19]

Mc Gregor, II

[11] Patent Number: 5,663,541

[45] Date of Patent: Sep. 2, 1997

[54] MANUAL SWITCH FOR DIRECT CURRENT REVERSIBLE ELECTRIC WINCH MOTORS

[76] Inventor: George M. Mc Gregor, II, P.O. Box 820, De Ridder, La. 70634

[21] Appl. No.: 617,193

[22] Filed: Mar. 18, 1996

[51] Int. Cl.[6] ..... H01H 3/00

[52] U.S. Cl. ..... 200/17 R

[58] Field of Search ..... 254/274–279; 200/17 R

[56] References Cited

U.S. PATENT DOCUMENTS

| | | | |
|---|---|---|---|
| 1,945,712 | 2/1934 | Wadd | 254/168 |
| 2,274,280 | 2/1942 | Stinson | 172/152 |
| 2,301,678 | 11/1942 | Brongersma | 74/565 |
| 4,566,199 | 1/1986 | Dansie et al. | 254/348 |
| 4,789,135 | 12/1988 | Watanabe | 254/362 |
| 5,167,400 | 12/1992 | Gazel-Anthoine | 254/275 |

*Primary Examiner*—Aditya Krishnan
*Attorney, Agent, or Firm*—John M. Harrison

[57] ABSTRACT

A manual switch for direct current reversible electric winch motors, which switch includes a switch housing that may be mounted on or built into the winch housing of an electric winch or connected by means of appropriate wiring to the electric winch motor for operating the winch under circumstances where automatic operation of the winch is not possible. The switch housing includes four fixed contacts that are electrically isolated from each other and from the housing and a pair of contact bars which are spring-loaded inside the housing to facilitate selective engagement with the respective fixed contacts responsive to manual operation of the switch to operate the reversible electric winch motor in the forward or reverse direction. The contact bars may be moved directly by hand manipulation of a handle-turret assembly attached to the switch housing or by a push-pull knob arrangement or more remotely, by energizing a pair of solenoids attached to the switch housing or a rotary actuator mounted on the switch housing or manipulating a remote handle connected to a remote handle bracket attached to the turret assembly of the switch housing by means of wires.

20 Claims, 5 Drawing Sheets

MANUAL SWITCH FOR DIRECT CURRENT REVERSIBLE ELECTRIC WINCH MOTORS

BACKGROUND OF THE INVENTION

1. Field of the Invention

This invention relates to winch systems for four-wheel drive vehicles and other vehicles and more particularly, to a manual switch for operating direct current (DC) reversible electric winch motors under circumstances where the conventional winch electrical operating system fails. The manual switch is designed to be mounted in or on the winch housing or electrically coupled to the DC electric winch motor in the winch to serve as a backup system for operating the winch. The manual switch of this invention may typically be operated in four ways, including hand-manipulation of a handle-turret assembly or a push-pull knob arrangement mounted on the switch housing, remotely manipulating the handle turret assembly by means of a remote handle connected to the turret by means of wires, and remotely operating the switch by means of solenoids or a rotary actuator mounted on the switch housing and connected to a toggle or other switch by appropriate wiring.

One of the problems inherent in the operation of conventional winch systems and particularly winch systems mounted on four-wheel drive vehicles used for hunting, oil and gas operations and other activities involving operation of the vehicles in remotely located places, is that of moisture, mud, corrosion and other contamination of the various electrical contacts and connections necessary to operate conventional winch systems. Conventional winches are typically operated by four solenoid (SPST) or two solenoid (DPST) electrical arrangements. External connections found in these winch configurations are extremely prone to malfunction due to corrosion, moisture, mud and other contaminants often found in the field where the winches are typically used. The advantage of the manual switch of this invention is that it minimizes the number of external connections necessary in conventional winch systems and provides a sealed housing filled with a contact fluid which prevents foreign matter, air and moisture from degrading the switch contact life. The manual switch of this invention is thus capable of manually operating a winch under circumstances where the conventional winch solenoid or electrical system fails, a common occurrence in the field. The manual switch may be mounted either directly on the winch motor by means of bus bar straps or connected remotely by means of wire leads. Alternatively, the switch can be configured in the winch frame itself, as desired. Furthermore, the manual switch of this invention can be configured in a manual-only mode by implementing a hand-operated, handle-turret assembly or it can be remotely operated by means of a pair of U-control wires connected to a bracket mounted on a rotatable turret attached to the switch housing, to distance the operator from the wire rope or cable in the winch in case the cable fails. Similar remote electrical operation can be effected by means of a pair of solenoids or a rotary actuator mounted on the winch housing and connected to the internal movable contact bars to effect the desired forward and reverse operation of the direct current reversible winch motor.

2. Description of the Prior Art

Various types of electric winches and hoists are known in the art. U.S. Pat. No. 1,945,712, dated Feb. 6, 1934, to R. J. Wadd, details a "Hoist" wherein the major elements of the hoist, which include the motor, wire rope, drum and reduction gearing between the motor and drum, are so closely and advantageously organized as to provide for a smooth and easy application of power of the motor to the drum in a balanced manner to prolong the life of the hoist and insure long term satisfactory and efficient operation. U.S. Pat. No. 2,274,280, dated Feb. 24, 1942, to K. W. Stinson details a hoist having a mechanical contrivence located between the control lever and the controller switch, such that in event that the control cords attached to the lever are too quickly operated in the act of reversing rotation of the motor shaft, the control mechanism will be temporarily locked for a period of time sufficient to permit the motor to come to a standstill. U.S. Pat. No. 2,301,678, dated Nov. 10, 1942, to C. Brongersma, details a "Controller Actuator" which embodies novel centrifugal weight and stop arrangements, such that the weight will be jammed against the stop to prevent full throw of the controller from one extreme position to the other except when the controller has shifted slowly. An "Electric Winch Apparatus" is detailed in U.S. Pat. No. 4,556,199, dated Dec. 3, 1985, to Ryan F. Dansie, et al. The device has an alternating current motor and direct current operable clutch and brake coils, together with a control circuit for energizing the apparatus. The control circuit includes alternating current switching of DC current flows, operator control of both reeling in and unreeling drum functions and selected use of separate brake release and brake hold-off coils, with a combination of full-wave and half-wave energizing currents. U.S. Pat. No. 4,789,135, dated Dec. 6, 1988, to H. Watanabe, details an "Operating Device For Electric Hoist". The device has a DC motor for raising and lowering an object and includes a low speed adjusting setting unit and a high speed adjusting setting unit provided in a control box. The operating device further includes a two-step push button switch for the raising operation, for switching over the low speed adjusting setting unit and the high speed adjusting setting unit to connect either of the units to a speed-change control circuit by pushing the two-step push button switch to either a first or a second step position. A second two-step push button switch energizes the lowering operation for switching over the low speed adjusting setting and the high speed adjusting setting units. U.S. Pat. No. 5,167,400, dated Dec. 1, 1992, to G. Anthoine, details a "Control Device For Lifting Winches, In Particular for Drilling Rigs". The control device includes a control circuit that facilitates controlled excitation of an electric motor. A manipulator on a control panel controls the control circuit by establishing, according to its position, a given speed request instruction. An indexing circuit for controlling the control circuit is adapted on the basis of predetermined end-of-travel positions and in accordance with a given law relating the speed to the difference in height between a given end of travel position and the actual height of the time in question, to establish a given speed request instruction. A comparator passes to the control circuit only the speed request instruction that it receives representing the lowest speed.

It is an object of this invention to provide a new and improved manual switch for direct current, reversible electric winches, which manual switch is designed to mount on or in the winch housing of the electric winch or electrically connect to the reversible DC motor in the electric winch to operate the DC electric motor in the forward and reverse directions exclusive of the conventional operating switches and electrical components of the winch.

Another object of this invention is to provide a new and improved manual winch switch which is characterized by a sealed switch housing mounted on or in the winch housing of an electric winch and connected to the DC reversible winch motor for operating the winch motor in the event of failure of the conventional electrical winch-operating system.

Yet another object of this invention is to provide a manual switch for mounting on or in a conventional DC electric winch housing and electrically connected to the reversible DC electric motor in the winch for manually operating the winch by hand-manipulation of a turret handle or push-pull knobs attached to the switch housing or remotely operating the switch by manipulation of a control handle connected to the switch housing by means of wires or by energizing a rotary actuator or solenoids mounted in the switch housing.

Another object of this invention is to provide a new and improved sealed, substantially fail-safe manual switch for operating a winch in the event of failure of the conventional winch electrical system, which manual switch includes a switch housing containing spring-loaded contact bars as well as fixed contacts insulated from the housing and from each other and located in a pool of contact fluid sealed in the housing, wherein the fixed contacts in the housing are connected to the reversible DC electric winch motor and the spring-loaded contact bars within the housing are selectively manipulated by hand-operation of a turret assembly or push-pull knobs mounted on the switch housing or by a remote handle connected to the fixed housing by means of wires or by means of a rotary actuator or a pair of solenoids mounted on the housing and connected to the contact bars and operated by a toggle switch, to operate the reversible DC electric winch motor when the conventional winch electrical system fails.

SUMMARY OF THE INVENTION

These and other objects of the invention are provided in a new and improved manual switch for direct current, reversible electric winch motors, which manual switch includes a switch housing that may be permanently or temporarily mounted on the winch housing of the electric winch. The switch housing includes four fixed metal contacts that are electrically insulated from each other and from the housing and a pair of spring-loaded metal contact bars, all positioned in a pool of electrical contact fluid and sealed within the housing to facilitate minimum contact and contact bar wear. Various mechanisms are provided for manually or remotely manipulating the contact bars against the bias of the springs within the housing for selectively energizing the DC reversible electric winch motor in the forward or reverse direction to operate the winch independently of the conventional winch electrical system. These apparatus include a manual, hand-operated handle-turret assembly or push-pull knob apparatus mounted on the switch housing and extending into the switch housing, the turret assembly adapted for engaging an insulated bushing which, in turn, engages the spring-loaded contact bars to facilitate manual manipulation of the contact bars and operation of the DC reversible electric winch motor. Another operating apparatus includes a remote handle bracket attached to the turret assembly and remote handle connected to the remote handle bracket by means of wires to facilitate operating the manual switch at a point remotely located from the winch, to guard against possible injury due to winch cable failure. A third technique for operating the switch of this invention includes mounting a rotary actuator or a pair of solenoids on both sides of the switch housing, which solenoids are connected to the parallel contact bars and the rotary actuator eccentrically engages the contact bars, to effect movement of the spring-loaded contact bars into the reverse or forward position responsive to energizing of the solenoids by means of a remotely-located toggle switch.

The invention will be better understood by reference to the accompanying drawing, wherein.

Figure 1:
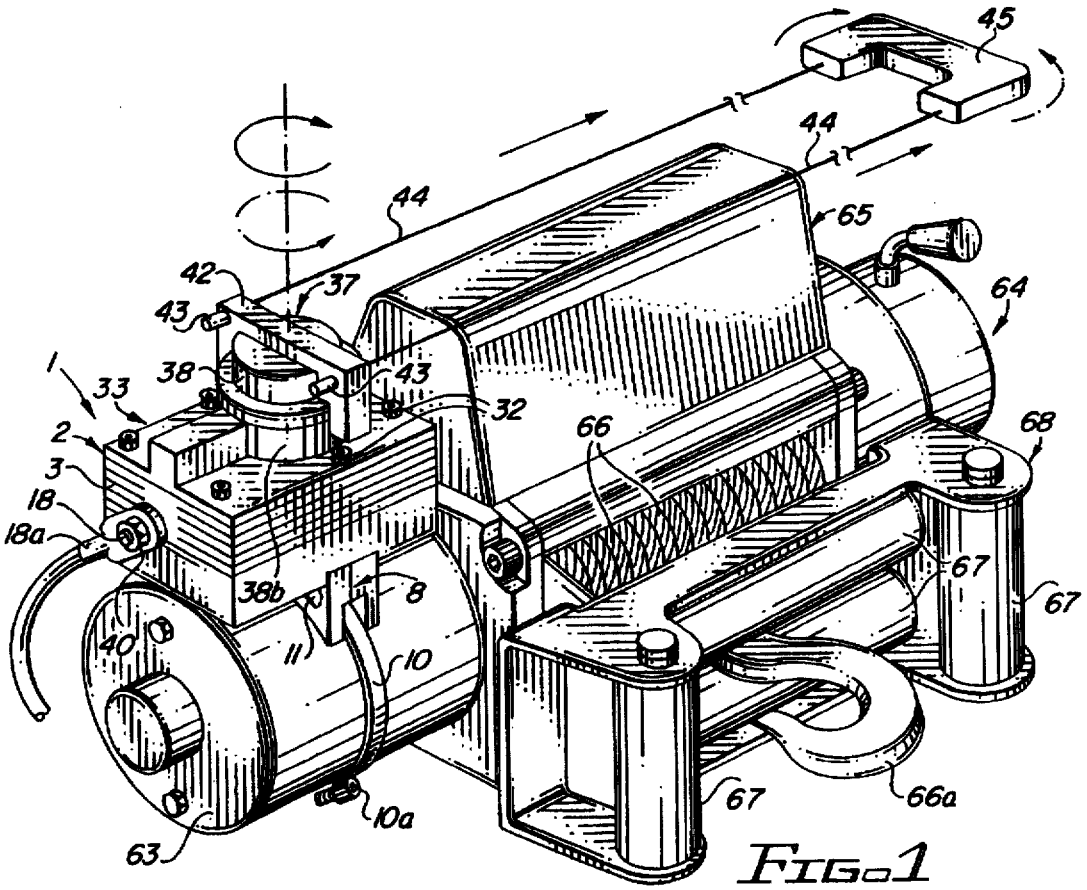
FIG. 1 is a perspective view of a preferred embodiment of the invention, wherein the manual switch of this invention is remotely operated by means of a remote handle and connecting wires.
Figure 9:
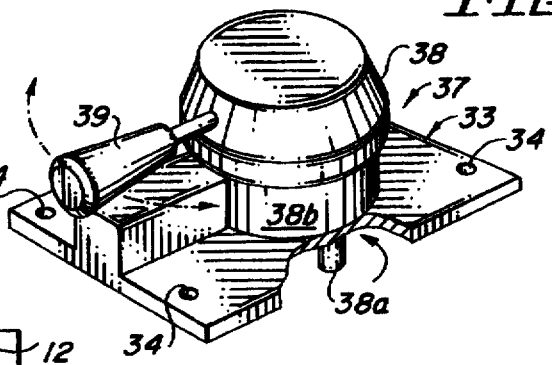
FIG. 9 is a perspective view of the cover of the manual switch, with a turret and handle mounted thereon, which cover is further illustrated in FIG. 4 of the drawings.
Figure 10:
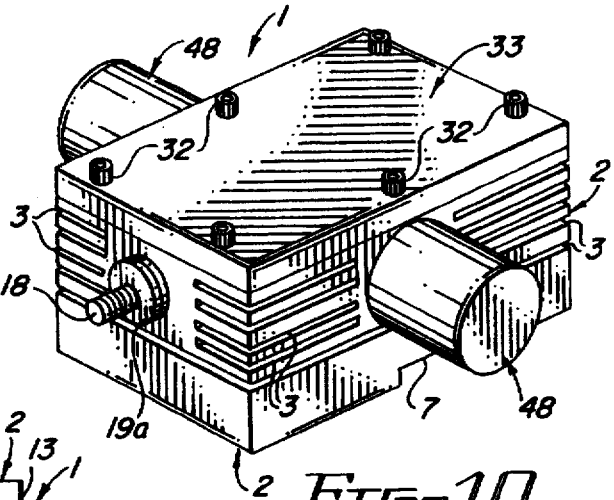
FIG. 10 is a perspective view of an alternative preferred embodiment of the invention wherein a pair of solenoids are mounted on the switch housing to facilitate remote operation of the manual switch using a toggle switch electrically connected to the solenoids.
Figure 13:
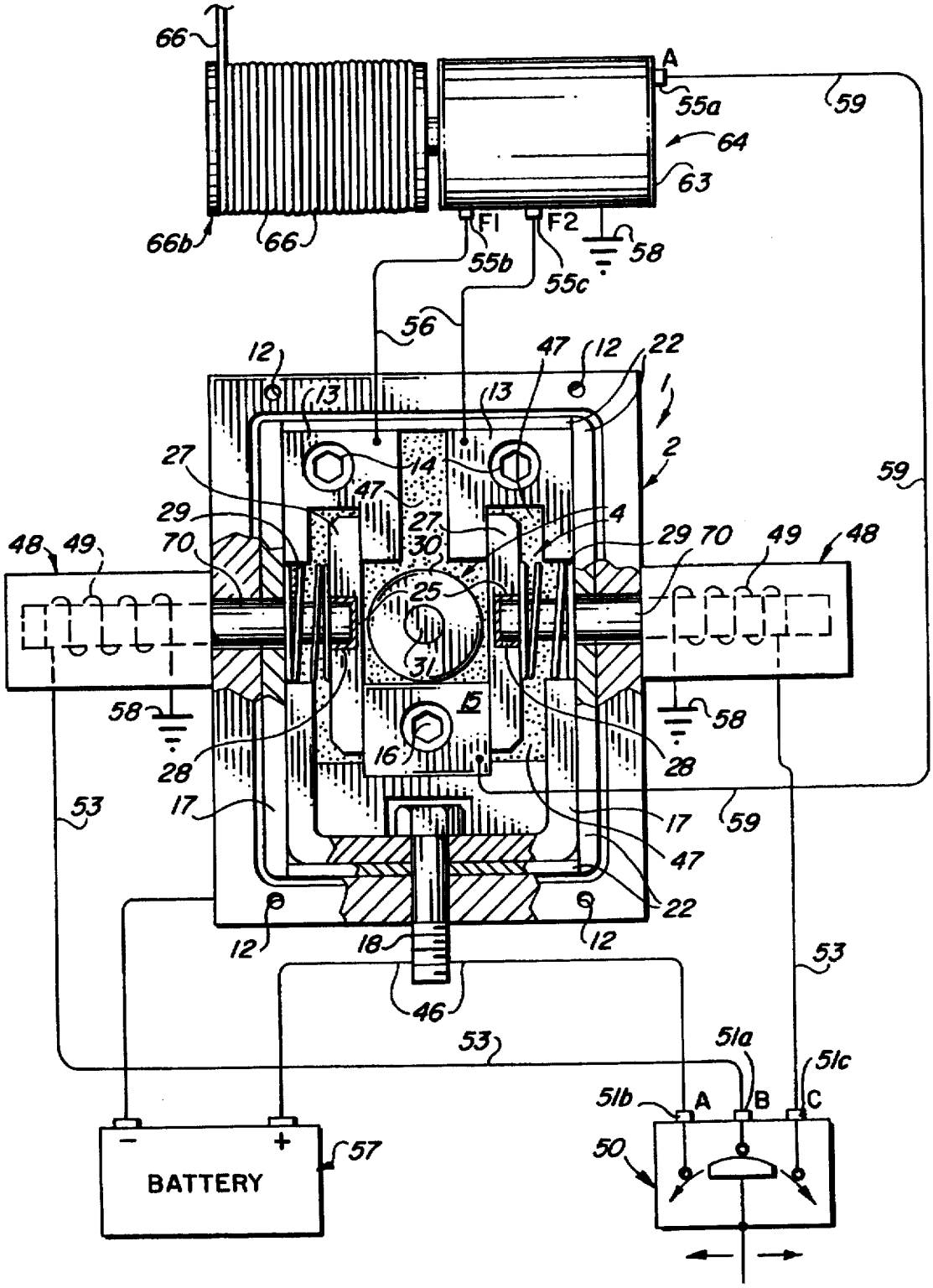
Figure 14:
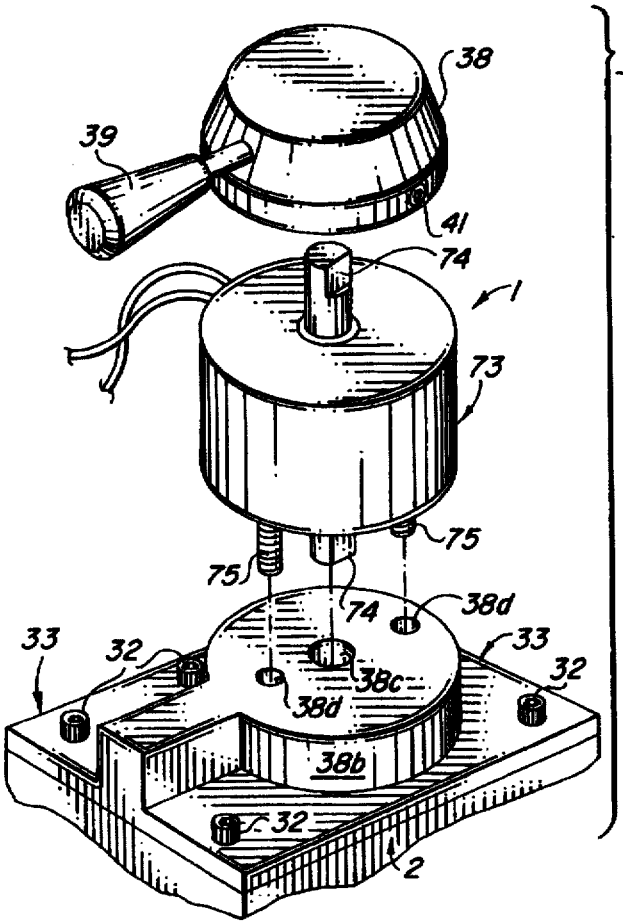
Figure 15:
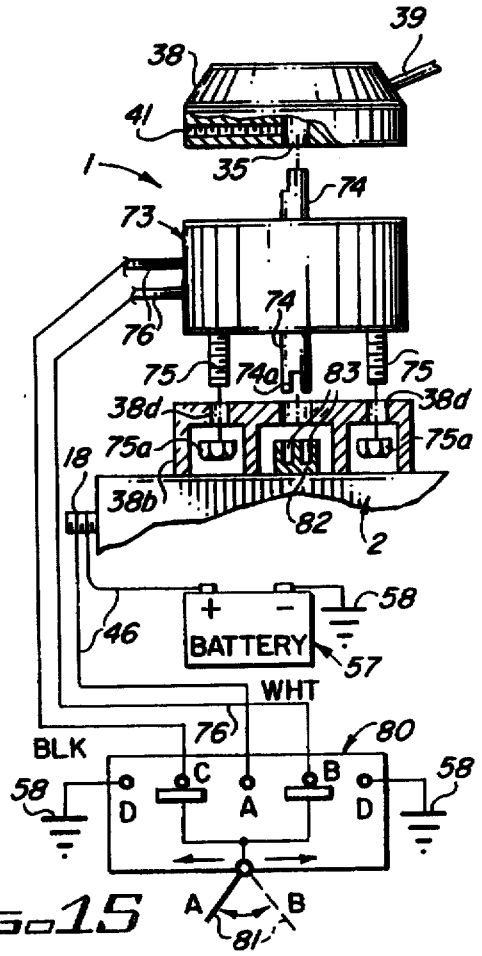
Figure 16A:
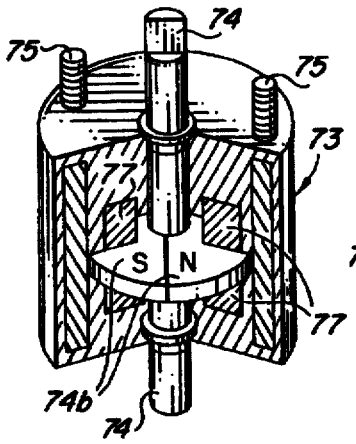
Figure 16B:
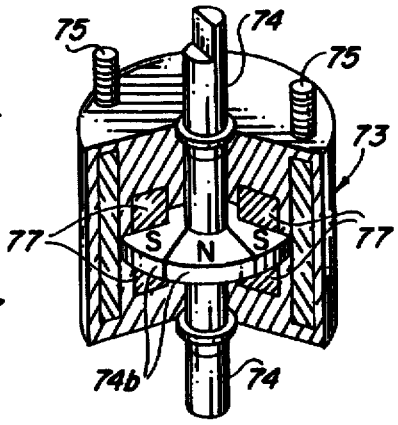
Figure 16C:
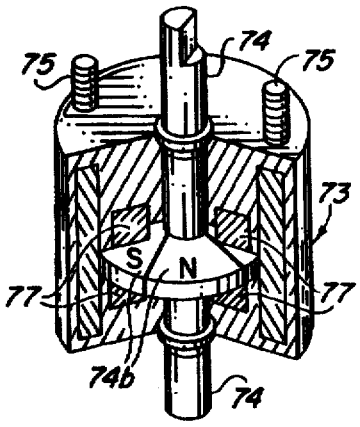

FIG. 13 is a top view of a reversible DC electric winch motor and cable drum and the switch housing of this invention with the cover removed, more particularly illustrating operation of the manual switch and electric motor, either by close proximity hand-manipulation of a switch handle and turret as illustrated in FIG. 9 or by remote switch operation using the remote handle and connecting wiring as illustrated in FIG. 1 or by means of a pair of solenoids, as illustrated in FIG. 10;

FIG. 14 is an exploded view of yet another alternative embodiment of the manual switch wherein a rotary actuator is inserted between the turret and switch housing for remote operation of the manual switch by means of a toggle switch;

FIG. 15 is an exploded, partially sectional view with schematic, of the rotary actuator and operating toggle switch; and FIG. 16A, 16B and 16C are sectional views of the rotary actuator in various operating configurations.

DESCRIPTION OF THE PREFERRED EMBODIMENTS

Figure 2:
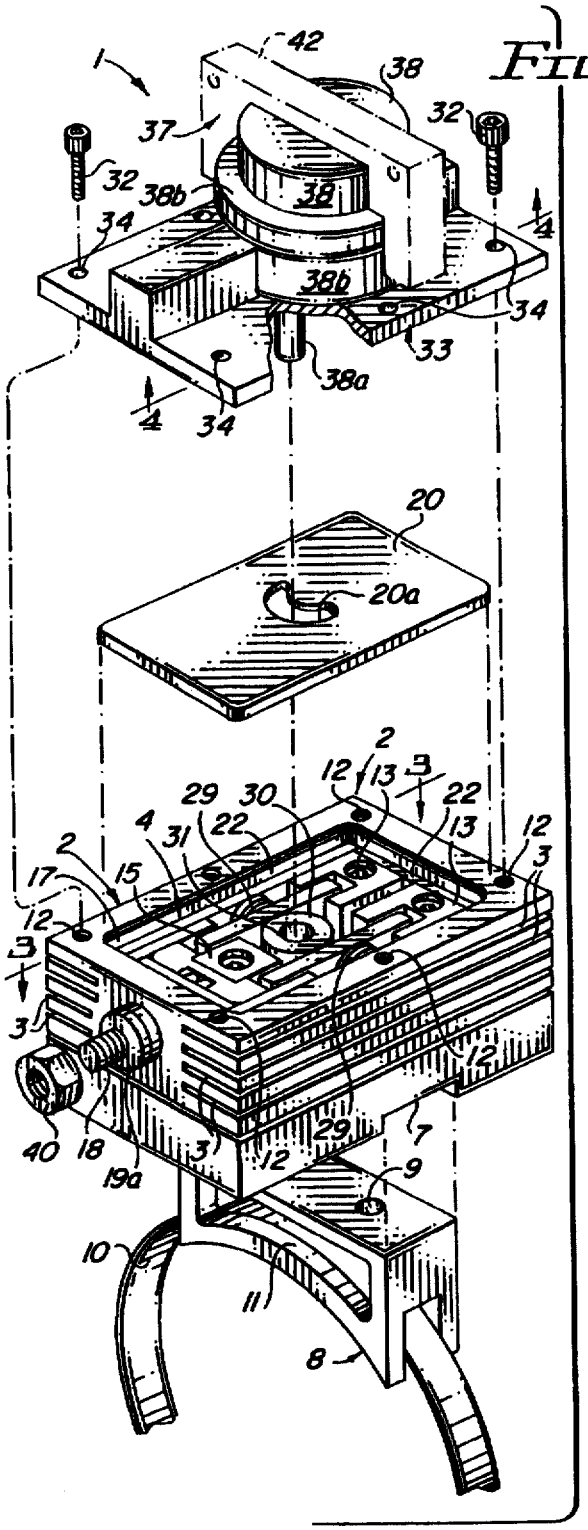
FIG. 2 is an exploded view of the manual switch illustrated in FIG. 1, more particularly illustrating a preferred technique for mounting the manual switch on the winch illustrated in FIG. 1, as well as the operating components of the manual switch.
Figure 7:
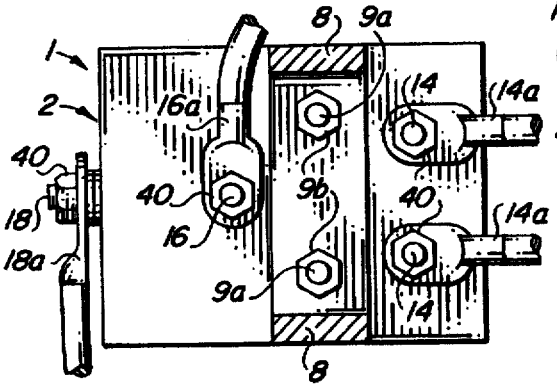
FIG. 7 is a bottom view of the switch housing illustrated in FIGS. 5 and 6, more particularly illustrating four terminals attached to the corresponding four fixed contacts located in the switch housing.
Figure 8:
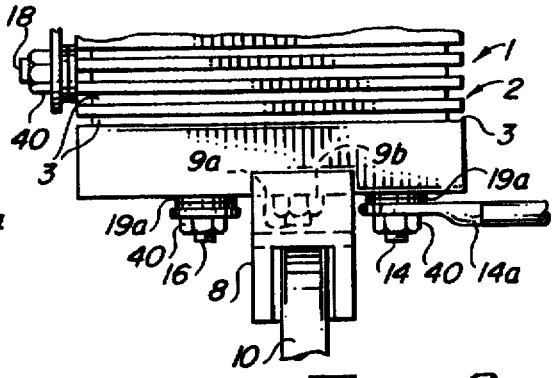
FIG. 8 is a side view, partially in section, of the switch housing, more particularly illustrating a preferred technique for mounting the manual switch on the winch motor, as illustrated in FIGS. 1 and 2.

Referring initially to FIGS. 1, 2, 8 and 9 of the drawings, the manual switch of this invention is generally illustrated by reference numeral 1 and includes a rectangular switch housing 2, having heat-dissipating housing slots 3 and a housing cavity 4, closed by a cover 33. The manual switch 1 is attached to the DC electric winch motor 63 of a DC electric winch 64, by means of a mount bracket 8 having a pair of mount bracket openings 9 and secured to the switch housing 2 of the manual switch 1 by means of a pair of housing bolts 9*a* and cooperating housing mount nuts 9*b*, as illustrated in FIGS. 7 and 8. In a preferred embodiment the mount bracket 8 is configured with a curved band seat 11, which receives a curved mount band 10 having a band screw 10*a* for tightly, yet removably, maintaining the manual switch 1 on the curved switch housing 2 of the DC electric winch motor 63, as illustrated in FIG. 1. The DC electric winch 64 is further characterized by a winch housing 65, a winch drum 66*b* (illustrated in FIG. 13) and a length of winch cable 66 wound on the winch drum 66*b*, with a cable hook 66*a* attached to the extending end of the winch cable 66, as further illustrated in FIG. 1. Vertical and horizontal cable guide rollers 67 serve to guide the winch cable 66 from the winch drum 66*b* in conventional fashion responsive to operation of the DC electric winch motor 63 using a conventional winch electrical system (not illustrated). As further illustrated in FIGS. 1 and 2 of the drawings, in a preferred embodiment the cover 33 is fitted with cover mount openings 34 and the switch housing 2 has corresponding housing mount openings 12 that are internally threaded to receive multiple cover mount bolts 32, which project through the registering cover mount openings 34 and threaded housing mount openings 12 to removably secure the cover 33 on the switch housing 2. In a most preferred embodiment of the invention the cover mount bolts 32 are cap screws, as illustrated in the drawings. In another preferred embodiment, a mount plate slot 7 is provided in the bottom of the switch housing 2 as illustrated in FIG. 2, to receive and stabilize the mount bracket 8, as further illustrated in FIG. 1.

Figure 3:
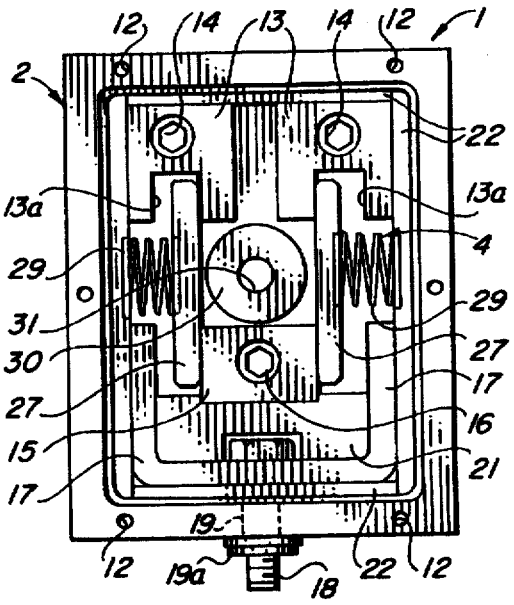
FIG. 3 is a top view of the manual switch illustrated in FIGS. 1 and 2 with the cover removed, more particularly illustrating preferred operating components of the switch.
Figure 4:
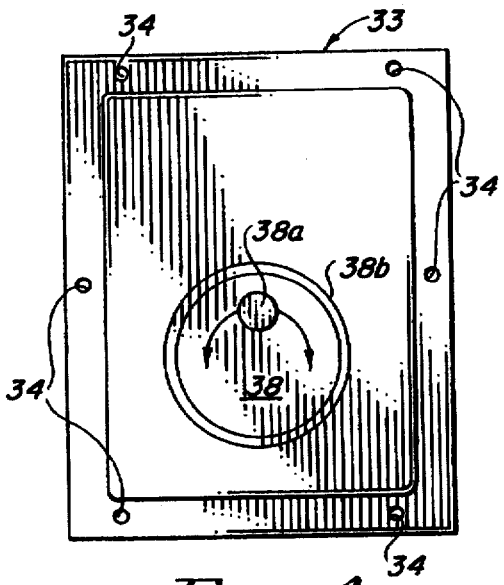
FIG. 4 is a bottom view of the cover element of the manual switch illustrated in FIGS. 1 and 2, more particularly illustrating a turret and turret pin for operating the manual switch of this invention.

Referring now to FIGS. 2 and 5–8 of the drawings, the switch housing 2 includes a pair of electrically conducting metal fixed top contacts 13, each fitted with a contact slot 13*a* and a top contact terminal 14 connected to a top contact cable 14*a* by means of terminal nuts 40. Similarly, a metal fixed middle contact 15 is spaced from the two top contacts 13 and is secured to the switch housing 2 by means of a middle contact terminal 16, connected to a middle contact cable 16*a* by means of a terminal nut 40. In like manner, a metal bottom contact 17 is spaced from the middle contact terminal 16 and is attached to the switch housing 2 by means of a bottom contact terminal 18, connected to a bottom contact cable 18*a* by means of a terminal nut 40. Insulating terminal sleeves 19 extend through the switch housing 2 and lie against the respective top contact terminal 14, middle contact terminal 16 and bottom contact terminal 18 and the respective terminal insulators 19*a*, to insulate the respective top contacts 13, middle contact 15 and bottom contact 17 from the switch housing 2. A flat cavity insulator 21 lies flat on the bottom of the switch housing 2 within the housing cavity 4 and serves to insulate the bottoms of the respective top contacts 13, middle contact 15 and the bottom contact 17 from the switch housing 2. Similarly, the side insulators 22 extend around the periphery of the housing cavity 4 and serve to insulate the respective sides of the top contacts 13, middle contact 15 and bottom contact 17 from the side to the switch housing 2. Since the bottom contact 17 is a generally U-shaped contact, a bottom contact insulator 21*a* serves to insulate the respective legs and base of the bottom contact 17 from the adjacent middle contact 15. A pair of electrically conducting metal contact bars 27 are disposed in the housing cavity 4 of the switch housing 2, with one end of the contact bars 27 positioned in the corresponding contact slot 13*a* provided in each of the top contacts 13, respectively, and the opposite ends of the contact bars 27 are positioned between the middle contact 15 and one leg of the U-shaped bottom contact 17, respectively, as further illustrated in FIGS. 5 and 6. A pair of contact springs 29 are disposed between the side insulators 22 and the respective contact bars 27 and in a preferred embodiment of the invention a bar depression 28 equal in size to the diameter of the contact springs 29, is provided in each of the contact bars 27 to receive and seat one end of the contact springs 29, as further illustrated in FIG. 5 and 6. Accordingly, referring now to FIG. 3 of the drawings, the contact springs 29 serve to normally bias the contact bars 27 inwardly against the inside legs of the top contacts 13 and against the middle contact 15, as illustrated. Referring again to FIG. 2 of the drawings, in a most preferred embodiment of the invention a handle insulator 20 is provided in the housing cavity 4 of the switch housing 2 between the top contacts 13, middle contact 15 and bottom contact 17 and the overlying cover 33 to insulate these contacts from the metal cover 33.

Figure 5:
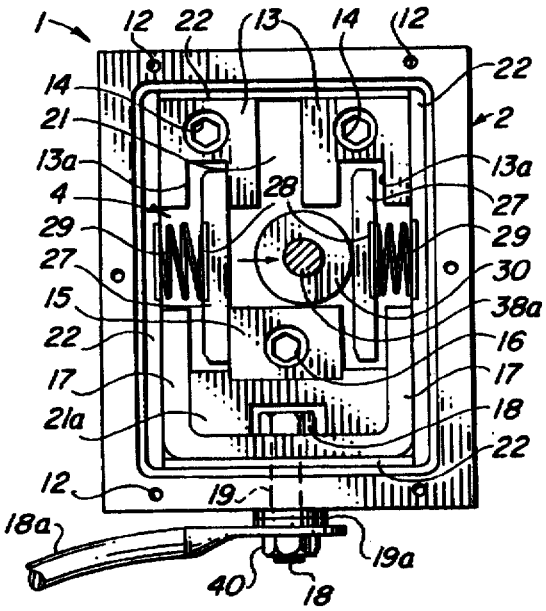
FIG. 5 is a top view of the switch housing, more particularly illustrating location of the spring-loaded contact bars in position to facilitate operation of the reversible DC electric winch motor in a first direction.
Figure 6:
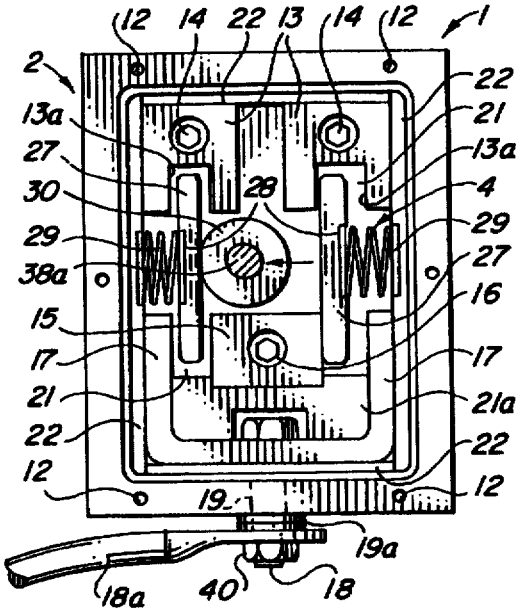
FIG. 6 is a top view of the switch housing illustrated in FIG. 5, more particularly illustrating positioning of the contact bars in the opposite position to facilitate rotation of the reversible DC electric winch motor in the opposite direction.

Referring again to FIGS. 1, 2, 4 and 9 of the drawings, in a most preferred embodiment of the invention the cover 33 includes a handle-turret assembly 37, featuring a round turret 38 which is rotatably mounted on a fixed turret base 38*b*, which turret 38 mounts a downwardly-extending turret pin 38*a* in eccentric relationship. A handle 39 may be fixed to the rotatable turret 38, as illustrated in FIG. 9. As further illustrated in FIG. 2, the turret pin 38*a* projects through a kidney-shaped pin opening 20*a* provided in the handle insulator 20 and registers with a corresponding bushing opening 31 in the insulated bushing 30, disposed in the housing cavity 4 between the respective contact bars 27, as illustrated in FIGS. 5 and 6. This arrangement facilitates manipulation of the handle 39 illustrated in FIG. 9, rotation of the turret 38 and corresponding translation of the turret pin 38*a* through the curvature of the pin opening 20*a*. Such action also moves the insulated bushing 30 from side to side in the housing cavity 4 to selectively engage the contact bars 27 and move the contact bars 27 against the bias in the respective contact springs 29 to operate the DC electric winch motor 63 in a forward or reverse direction, as hereinafter described.

Figure 11:
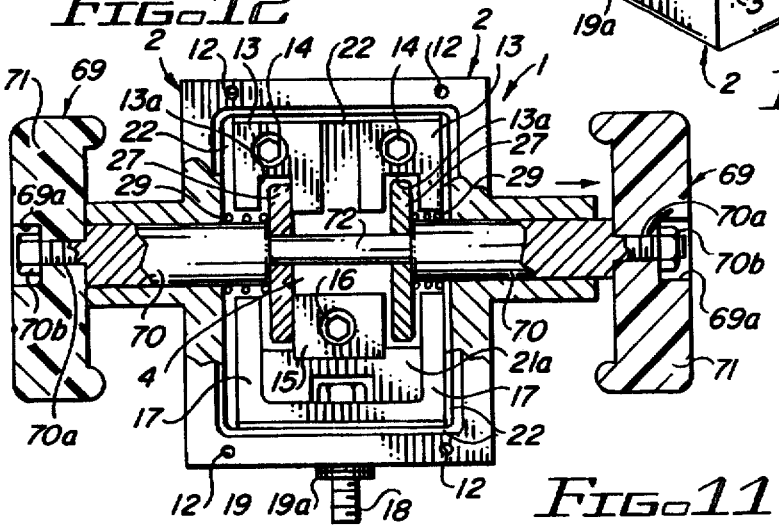
FIG. 11 is a sectional view of a still further alternative embodiment of the manual switch of this invention wherein a pair of push-pull knobs are connected to the internal contact bars located in the switch housing of the manual switch for manually hand-operating the manual switch.

Referring now to FIG. 11 of the drawings, in another preferred embodiment of the invention the contact bars 27 can be manipulated by means of oppositely-disposed push-pull knobs 69, mounted in the switch housing 2 of the manual switch 1 by means of contact bars 70, attached to the knob handles 71 of the push-pull knobs 69, by means of stud nuts 70*b*, threadably attached to the respective threaded bar studs 78, each extending into a knob recess 69*a* provided in each of the knob handles 71. The inwardly-extending ends of the contact bars 70 are attached to a connecting bar 72 that extends through the respective contact bars 27 to facilitate movement of the contact bars 27 back and forth in concert in the contact slots 13*a* provided in the top contacts 13 and in the slot or space between the middle contact 16 and the legs of the bottom contact 17, as illustrated.

Figure 12:
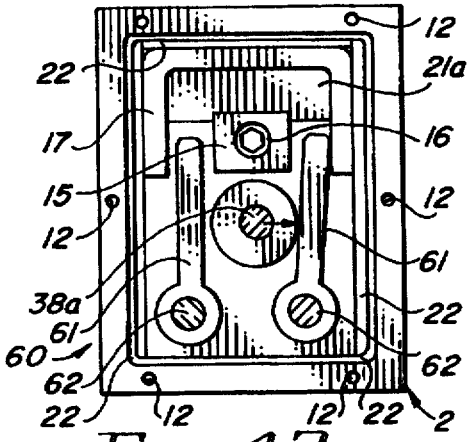
FIG. 12 is a top view of an alternative preferred design of the switch housing, wherein a pair of pivoting contact bars are positioned in close proximity to a pair of fixed contacts for operating the reversible direct current electric motor illustrated in FIG. 1.

Referring now to FIG. 12 of the drawings, in yet another alternative preferred embodiment of the invention the manual switch 1 can be characterized as a rotary switch 60, provided with a pair of pivoting contact bars 61, mounted on pivot pins 62 attached to the switch housing 2. Accordingly, movement of the insulated bushing 30 by operation of the corresponding turret 38 and handle 39 pivots a selected one of the pivoting contact bars 61 into the appropriate position to facilitate forward and reverse operation of the DC electric winch motor 63, as hereinafter further described.

Referring next to FIGS. 10 and 13 of the drawings, in yet another preferred embodiment of the invention a pair of solenoids 48 can be mounted on the switch housing 2 of the manual switch 1, with the solenoid bars 70 attached by means of insulating caps 25 to the respective contact bars 27 located in the interior of the switch housing 2 and the contact springs 29 encircling the interior portions of the solenoid bar 70, as illustrated in FIG. 13. Solenoid windings 49 are wrapped around that portion of the solenoid bars 70 which are located within the respective solenoids 49 and one end of each of the solenoid windings 49 is attached to a ground 58, while the other ends of the respective solenoid windings 49 are connected to switch terminals 51*b* and 51*c*, respectively, of a solenoid toggle switch 50, by means of switch solenoid wiring 53. The third toggle switch terminal 51*a* is connected to the positive terminal of a battery 57 and the bottom contact terminal 18 by means of battery-switch wiring 46, as further illustrated in FIG. 13. The negative terminal of the battery 57 is grounded to the switch housing 2. Accordingly, operation of the respective solenoids 48 by manipulation of the toggle 52 of the solenoid toggle switch 50 retracts each of the contact bars 27 in sequence and selectively against the bias in the respective contact springs 29, to effect forward and reverse operation of the DC electric winch motor 63, as hereinafter further described.

Referring to the drawings and particularly to FIG. 13, it will be appreciated that the top contacts 13 of the manual switch 1 are connected to the motor terminals 55*b* and 55*c* of the DC electric winch motor 63 by means of top contact-motor wiring 56. Furthermore, the middle contact 15 is similarly connected to the motor terminal 55*a* of the DC electric winch motor 63 by means of middle contact-motor wiring 59. Accordingly, in operation, under circumstances where it is desired to manually operate the DC electric winch motor 63 using the handle assembly 37 illustrated in FIG. 9, the handle 39 is manipulated to rotate the corresponding turret 38 and translate the turret pin 38*a* to force the insulated bushing 30 against a selected one of the contact bars 27 and effect forward or reverse rotation of the DC electric winch motor 63, as illustrated in FIGS. 5 and 6 of the drawings. The push-pull knobs 69, illustrated in FIG. 11, may be similarly manipulated to effect the same result, as heretofore described. Direct manual operation of the DC electric winch motor 63 by operation of the manual switch 1 can thus be effected by manually manipulating the handle 39 as illustrated in FIG. 9 or the respective push-pull knobs 69 illustrated in FIG. 11, under circumstances where there is no immediate concern of the winch cable 66 breaking and injuring the operator during operation of the DC electric winch 64.

Alternatively, under circumstances where the user desires to avoid the immediate proximity of the winch cable 66, he may install a remote handle bracket 42 on the rotatable turret 38 and attach one end of the remote handle wires 44 to the remote handle bracket 42 using the wire mounts 43. The opposite ends of the remote handle wires 44 are attached to the remote handle 45 as illustrated in FIG. 1, such that the turret 38 may be rotated in lieu of using the handle 39 illustrated in FIG. 9, by manipulating the remote handle 45 to operate the DC electric winch motor 63 from a remote location.

Still further in the alternative and referring again to FIGS. 10 and 13 of the drawings, the solenoids 48 may be operated from a remote location using the solenoid toggle switch 50, which is connected to the battery 57 at the positive terminal and the solenoid windings 49 of the respective solenoids 48, as heretofore described to further effect movement of the contact bars 27 against the bias of the respective contact springs 29 and operation of the DC electric winch motor 63 in the forward or reverse direction.

Referring now to FIGS. 14, 15 and 16 of the drawings in yet another preferred embodiment of the invention a rotary actuator 73 can be inserted between the turret 38 and the turret base 38*b* of the manual switch 1. An armature 74 extends through the rotary actuator 73 and is fitted with armature magnets 74*b*, as illustrated in FIGS. 16*a*, 16*b* and 16*c*. Furthermore, the bottom end of the armature 74 is fitted with spaced armature splines 7*a* for engaging corresponding cam stem slots 83 and a cam stem 82, which is seated in the switch housing 2 and extends through the arcuate pin opening 20*a* in the handle insulator 20 for engagement with the bushing opening 31 in the insulated bushing 30, as illustrated in FIG. 2. As further illustrated in FIGS. 16*a*, 16*b* and 16*c* a stator 77 is provided in the rotary actuator 73 and is split by the pivoting armature magnets 74*b*, mounted on the armature 74, for purposes which will be hereinafter further described. A pair of threaded studs 75 extend from the rotary actuator 73 through corresponding threaded stud openings 38*d* provided in the turret base 38*b* and stud nuts 75*a* engage the threaded stud 75, as illustrated in FIG. 15 to removably secure the rotary actuator 73 on the turret base 38*b*. When the rotary actuator 73 is so secured, the spaced armature splines 74*a* extend into the corresponding cam stem slots 83 of the cam stem 82 to facilitate rotary motion of the cam stem 82, with corresponding rotary motion of the armature 74, as further hereinafter described. Actuator wiring 76 is wired into the terminals "A" and "C" of a toggle switch 80, as further illustrated in FIG. 15, while terminal "B" of the toggle switch 80 is connected to the bottom contact terminal 18 of the manual switch housing 2 by means of battery-switch wiring 46. The positive terminal of the battery 57 is also connected to the bottom contact terminal 18 of the switch housing 2 by means of battery-switch wiring 46. The negative terminal of the battery 57 is connected to ground 58. The "D" terminals of the toggle switch 80 are also connected to ground 58 and a toggle 81 is provided in the toggle switch 80 for operation of the toggle switch 80 as hereinafter further described.

In operation, the rotary actuator 73 embodiment of the manual switch 1 is operated as follows: In a first preferred embodiment rotary actuator 73 can be remotely operated, typically by means of a remote handle 45, remote handle wires 44 and a cooperating turret assembly 37 in the same manner as heretofore described with respect to FIG. 1. It will be appreciated by those skilled in the art that this embodiment may be implemented with or without installation of the turret 38 on the rotary actuator 73, typically by extension of the armature 74 into the turret opening 35, where it is secured by an allen screw 41. In another preferred embodiment of the invention the rotary actuator 73 can be manually operated by manipulating the handle 39 and turret 38 in the same manner as heretofore described with respect to FIG. 9 of the drawing. In either the remote or manual operation, the bottom protruding end of the armature 74 is pivoted or rotated in the manner illustrated in FIGS. 16A, 16B and 16C to, in turn, rotate or pivot the cam stem 82, which operates the manual switch 1 by means of the arcuated pin opening 20*a* in the handle insulator 20 and the insulated bushing 30 in the manner heretofore described. As further illustrated in FIG. 16A, the rotary actuator 73 is de-energized when no current is applied to the stator 77 and the armature 74 is in the fixed position illustrated. However, referring now to FIG. 16B, under circumstances where the toggle 81 of the toggle switch 80 is manipulated into the "A" position illustrated in FIG. 15 the stator 77 is energized and interacts with the armature magnet 74*b* on the armature 74 to pivot the armature into the position illustrated in FIG. 16B. Conversely, as illustrated in FIG. 16C, when the toggle 81 of the toggle switch 80 is manipulated into the phantom "B" position illustrated in FIG. 15, the stator poles are polarized such that the armature 74 is pivoted into the position illustrated. As heretofore described, under circumstances where the turret 38 is mounted on the manual switch 1 as illustrated in FIGS. 14 and 15, the armature 74 can be manually rotated or pivoted into the positions illustrated in FIGS. 16B and 16C from the position illustrated in FIG. 16A, to manually operate the manual switch 1 in the same manner as illustrated and described above with respect to FIG. 9.

It will be appreciated by those skilled in the art that the respective cavity insulator 21, side insulators 22, insulated bushing 30 and end insulators 25 are preferably and typically constructed of a high pressure laminated phenolic material which is well known to those skilled in the art as a sufficient electrical insulator. Furthermore, a suitable silicon base contact fluid 47, illustrated in FIG. 13, having metal suspended therein to allow conduction may be utilized in the housing cavity 4 of the switch housing 2 in order to preserve the contact points of the respective top contacts 13, middle contact 15, bottom contact 17, with the movable contact bars 27.

It will be further appreciated by those skilled in the art that the manual switch of this invention is a versatile, long-lasting, substantially fail-safe switch for operating substantially any reversible DC electric motor winch if the conventional electrical system of the winch fails. Furthermore, the manual switch can be operated either in close proximity to the winch or remotely located from it, by either manual or electrical manipulation, as desired.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A manual winch switch for attachment to a battery and manually operating a reversible, direct current motor, said manual winch switch comprising a switch housing; a pair of top contacts fixedly mounted in said switch housing in spaced relationship with respect to each other and a contact slot provided in each of said top contacts; a middle contact fixedly mounted in said switch housing in spaced relationship with respect to said top contacts, said middle contact substantially aligned, respectfully, with said contact slot in said top contacts; a bottom contact fixedly mounted in said switch housing in spaced relationship with respect to said top contacts and said middle contact, said bottom contact substantially aligned, respectively, with said contact slot in said top contacts; wiring means electrically connecting said top contacts, and said middle contact to said motor and said bottom contact electrically connected to the battery; insulation means disposed in said switch housing between said switch housing and said top contacts, said middle contact, and said bottom contact for insulating said top contacts, said middle contact and said bottom contact from each other and from said switch housing; a pair of contact bars movably disposed in said switch housing, said contact bars each having one end disposed, respectively, in said contact slot provided in said top contacts and the opposite ends of said contact bars disposed, respectively, between said middle contact and said bottom contact; bias means disposed between said contact bars and said insulation means for normally biasing said contact bars against said top contacts and said middle contact; and engaging means engaging at least one of said contact bars, for selectively forcing said contact bars against a selected one of said top contacts, said middle contact and said bottom contact against the bias of said bias means and operating the reversible, direct current motor in a selected direction of rotation responsive to manipulation of said engaging means.

2. The manual winch switch of claim 1 wherein said engaging means comprises a pair of solenoid means carried by said switch housing, said solenoid means electrically connected to the battery and said solenoid means further connected to said contact bars in said switch housing for selectively electrically forcing said contact bars against a selected one of said top contacts, said middle contact and said bottom contact against the bias of said bias means.

3. The manual winch switch of claim 1 wherein said engaging means comprises an insulated bushing disposed between said contact bars and handle means pivotally mounted on said switch housing, said handle means engaging said insulated bushing for manually forcing said insulated bushing against a selected one of said contact bars and operating the reversible, direct current motor in said selected direction of rotation.

4. The manual winch switch of claim 3 comprising a pair of solenoid means carried by said switch housing, said solenoid means electrically connected to the battery and said solenoid means further connected to said contact bars in said switch housing for selectively electrically forcing said contact bars against a selected one of said top contacts, said middle contact and said bottom contact against the bias of said bias means.

5. The manual winch switch of claim 3 wherein said handle means comprises a single handle, a turret fixedly receiving said handle, said turret rotatably mounted on said switch housing and a pin eccentrically connected to said turret for engaging said insulated bushing.

6. The manual winch switch of claim 5 comprising a rotary actuator disposed between said handle and said turret, said rotary actuator electrically connected to the battery and said rotary actuator further connected to said pin in said switch housing for selectively electrically forcing said contact bars against a selected one of said top contacts, said middle contact and said bottom contact against the bias of said bias means.

7. The manual winch switch of claim 1 wherein said engaging means comprises a pair of knobs slidably disposed in said switch housing and connected to said contact bars in push-pull relationship for forcing said contact bars against a selected one of said top contacts, said middle contact and said bottom contact against the bias of said bias means.

8. The manual winch switch of claim 1 wherein said bias means comprises a pair of coil springs.

9. The manual winch switch of claim 5 comprising handle bracket means connected to said turret, a pair of wires having one end connected to said bracket means in spaced relationship with respect to each other and a remote handle connected to the opposite end of said wires, whereby said turret is rotated to operate the reversible, direct current motor responsive to manipulation of said remote handle.

10. The manual winch switch of claim 9 comprising a pair of solenoid means carried by said switch housing, said solenoid means electrically connected to the battery and said solenoid means connected to said contact bars in said switch housing for selectively electrically forcing said contact bars against a selected one of said top contacts, said middle contact and said bottom contact against the bias of said bias means.

11. The manual winch switch of claim 10 wherein said bias means comprises a pair of coil springs.

12. A manual winch switch for attachment to a battery and manually operating a reversible, direct current motor in a winch, said manual winch switch comprising a switch housing; a pair of top contacts fixedly mounted in said switch housing in spaced relationship with respect to each other and a contact slot provided in each of said top contacts; a middle contact fixedly mounted in said switch housing in spaced relationship with respect to said top contacts, said middle contact substantially aligned, respectfully, with said contact slot in said top contacts; a generally U-shaped bottom contact fixedly mounted in said switch housing in spaced relationship with respect to said top contacts and said middle contact, said bottom contact substantially aligned, respectively, with said contact slot in said top contacts; wiring electrically connecting said top contacts and said middle contact to said motor and said bottom contact electrically connected to the battery; insulation means disposed between said top contacts, said middle contact and said switch housing and between said middle contact and said bottom contact for insulating said top contacts, said middle contact and said bottom contact from each other and from said switch housing; a pair of contact bars movably disposed in said switch housing, said contact bars each having one end disposed, respectively, in said contact slot provided in said top contacts and the opposite ends of said contact bars disposed, respectively, between said middle contact and said U-shaped bottom contact; and bias means disposed between said contact bars and said insulation means for normally biasing said contact bars against said top contacts and said middle contact; and engaging means engaging at least one of said contact bars, for forcing said contact bars against a selected one of said top contacts, said middle contact and said bottom contact against the bias of said bias means and operating the reversible, direct current motor in a selected direction of rotation responsive to manipulation of said engaging means.

13. The manual winch switch of claim 12 wherein said engaging means comprises a pair of solenoids mounted on said switch housing in oppositely-disposed relationship with respect to each other, said solenoids electrically connected to the battery and said solenoids further connected to said contact bars in said switch housing for selectively electrically forcing said contact bars against a selected one of said top contacts, said middle contact and said bottom contact against the bias of said bias means.

14. The manual winch switch of claim 12 wherein said engaging means comprises an insulated bushing disposed between said contact bars and handle means pivotally mounted on said switch housing, said handle means engaging said insulated bushing for manually forcing said insulated bushing against a selected one of said contact bars and operating the reversible, direct current motor in said selected direction of rotation.

15. The manual winch switch of claim 14 wherein said handle means comprises a single handle, a turret fixedly receiving said handle, said turret rotatably mounted on said switch housing, a rotary actuator disposed between said handle and said turret, said rotary actuator electrically connected to the battery and said rotary actuator further connected to said pin in said switch housing for selectively electrically forcing said contact bars against a selected one of said top contacts, said middle contact and said bottom contact against the bias of said bias means, and a pin eccentrically connected to said rotary actuator for engaging said insulated bushing.

16. The manual winch switch of claim 15 wherein said bias means comprises a pair of coil springs.

17. The manual winch switch of claim 12 wherein said engaging means comprises a pair of knobs slidably disposed in said switch housing and connected to said contact bars in push-pull relationship for forcing said contact bars against a selected one of said top contacts, said middle contact and said bottom contact against the bias of said bias means.

18. The manual winch switch of claim 15 comprising handle bracket means connected to said turret, a pair of wires having one end connected to said bracket means in spaced relationship with respect to each other and a remote handle connected to the opposite end of said wires, whereby said turret is rotated to operate the reversible, direct current motor responsive to manipulation of said remote handle.

19. A manual winch switch for attachment to a battery and manually operating a reversible, direct current motor in a winch, said manual winch switch comprising a switch housing having a removable cover; a pair of top contacts fixedly mounted in said switch housing in spaced relationship with respect to each other and a contact to said motor slot provided in each of said top contacts and a middle contact fixedly mounted in said switch housing in spaced relationship with respect to said top contacts, said middle contact substantially aligned, respectfully, with said contact slot in said top contacts; a generally U-shaped bottom contact fixedly mounted in said switch housing in spaced relationship with respect to said top contacts and said middle contact, said bottom contact substantially aligned, respectively, with said contact slot in said top contacts; wiring connecting said top contacts, said middle contact and said bottom contact to the battery and the reversible, direct current motor in the winch insulation means disposed between said top contacts, said middle contacts and said switch housing and between said middle contact and said bottom contact for insulating said top contacts, said middle contact and said bottom contact from each other and from said switch housing; a pair of contact bars movably disposed in said switch housing, said contact bars each having one end disposed, respectively, in said contact slot provided in said top contacts and the opposite ends of said contact bars disposed, respectively, between said middle contact and said U-shaped bottom contact; a pair of coil springs disposed between said contact bars and said insulation means for normally biasing said contact bars against said top contacts and said middle contact an insulated bushing disposed between said contact bars for selectively engaging said contact bars and handle means pivotally mounted in said cover, said handle means engaging said insulated bushing, whereby said contact bars are selectively engaged by said insulated bushing for forcing said contact bars against a selected one of said top contacts, said middle contact and said bottom contact against the bias of said bias means and operating the reversible, direct current motor in a selected direction of rotation responsive to manipulation of said handle means.

20. The manual winch switch of claim 19 wherein said handle means comprises a single handle, a turret fixedly receiving said handle, said turret rotatably mounted on said switch housing and a pin eccentrically connected to said turret for engaging said insulated bushing.

* * * * *